US008336428B2

(12) United States Patent
Johnson et al.

(10) Patent No.: US 8,336,428 B2
(45) Date of Patent: Dec. 25, 2012

(54) UNIVERSAL RATCHETING TOOL

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., Los Gatos, CA (US)

( * ) Notice: Subject to any disclaimer, the term of this patent is extended or adjusted under 35 U.S.C. 154(b) by 0 days.

(21) Appl. No.: 13/228,326

(22) Filed: Sep. 8, 2011

(65) Prior Publication Data

US 2012/0000322 A1 Jan. 5, 2012

Related U.S. Application Data

(63) Continuation of application No. 12/009,524, filed on Jan. 17, 2008, now Pat. No. 8,033,200.

(51) Int. Cl.
*B25B 13/46* (2006.01)
*B25B 23/16* (2006.01)

(52) U.S. Cl. ..... 81/60; 81/438

(58) Field of Classification Search ..... 81/60, 28, 81/29, 31–33, 61–63.2, 58–58.5, 437, 438
See application file for complete search history.

(56) References Cited

U.S. PATENT DOCUMENTS

| | | | | |
|---|---|---|---|---|
| 244,309 | A | 7/1881 | Rhodes | |
| 363,331 | A | 5/1887 | Hammer | |
| 364,422 | A * | 6/1887 | Laforge | 81/30 |
| 580,235 | A | 4/1897 | Strum | |
| 647,528 | A | 4/1900 | Schmidt | |
| 763,745 | A | 6/1904 | Gheen | |
| 873,363 | A | 12/1907 | Ross | |
| 875,493 | A * | 12/1907 | Beard | 279/36 |
| 959,408 | A * | 5/1910 | Volbert | 81/32 |
| 1,000,900 | A | 8/1911 | Dorsey | |
| 1,006,679 | A | 10/1911 | Rice | |
| 1,100,070 | A * | 6/1914 | Graham | 81/32 |
| 1,172,656 | A | 2/1916 | Yorgensen | |
| 1,187,842 | A | 6/1916 | Kaas | |

(Continued)

FOREIGN PATENT DOCUMENTS

CA 1147176 5/1983

(Continued)

*Primary Examiner* — David B Thomas
(74) *Attorney, Agent, or Firm* — Haverstock & Owens LLP

(57) ABSTRACT

A universal ratcheting tool provides improved handling of tools that are difficult to use on their own, specifically, hexagonal wrenches. The universal ratcheting tool includes a handle and a body with a ratcheting mechanism within the handle. The body includes a first aperture for receiving a tool, and the first aperture includes slots to accept a plurality of sizes of tools. The body also includes a second aperture where the tool extends out of the body. A retaining component is coupled with the body to retain the tool and a retaining tab is able to be used to open and close the retaining component. Once the tool is positioned and retained within the universal ratcheting tool, a user is able to easily install or remove an object such as a screw with the benefit of a comfortable handle and the ease of use of the ratcheting mechanism.

24 Claims, 8 Drawing Sheets

U.S. PATENT DOCUMENTS

| | | | | | |
|---|---|---|---|---|---|
| D53,597 | S | | 7/1919 | Marcmann | |
| 1,398,583 | A | | 11/1921 | Bovee | |
| 1,425,270 | A | * | 8/1922 | Saxton | 81/28 |
| 1,500,852 | A | | 7/1924 | Shepard | |
| 1,502,044 | A | | 7/1924 | McCann | |
| 1,530,905 | A | | 3/1925 | Nance | |
| 1,559,097 | A | | 10/1925 | Hill | |
| 1,753,026 | A | | 4/1930 | Rosati | |
| 1,825,936 | A | * | 10/1931 | Bodmer | 192/43.1 |
| 1,888,222 | A | | 11/1932 | Curtis et al. | |
| 1,915,245 | A | * | 6/1933 | Cook | 81/29 |
| 1,944,606 | A | | 1/1934 | Little | |
| 1,970,409 | A | * | 8/1934 | Wiedemann | 81/30 |
| 2,236,333 | A | | 3/1941 | Cowles | |
| 2,332,656 | A | | 10/1943 | Mirando | |
| 2,346,364 | A | | 4/1944 | Dowe | |
| D142,982 | S | | 11/1945 | Bloomfield | |
| 2,409,613 | A | | 10/1946 | Brooks | |
| 2,410,971 | A | | 11/1946 | Hartley | |
| 2,465,619 | A | | 3/1949 | Veit | |
| 2,475,268 | A | | 7/1949 | Wittle | |
| 2,485,991 | A | * | 10/1949 | Stowell | 81/32 |
| D156,677 | S | | 12/1949 | Smith | |
| D157,154 | S | | 2/1950 | Horton | |
| 2,509,507 | A | | 5/1950 | Kane | |
| 2,512,967 | A | | 6/1950 | Quiron | |
| 2,530,024 | A | | 11/1950 | Moody | |
| 2,532,636 | A | | 12/1950 | Minnich | |
| 2,569,069 | A | | 9/1951 | Motel | |
| 2,590,307 | A | | 3/1952 | Gibson | |
| 2,593,828 | A | | 4/1952 | Arey | |
| 2,604,211 | A | | 7/1952 | Steine | |
| 2,701,052 | A | | 2/1955 | Mantel | |
| D175,056 | S | | 6/1955 | Wilson | |
| 2,715,028 | A | | 8/1955 | Dossie | |
| 2,719,042 | A | | 9/1955 | Epsy | |
| 2,776,589 | A | | 1/1957 | Gregory | |
| 2,778,396 | A | | 1/1957 | Swain | |
| D179,979 | S | | 4/1957 | Noga | |
| 2,800,816 | A | | 7/1957 | Tasciotti | |
| 2,804,970 | A | | 9/1957 | Kuc et al. | |
| 2,810,472 | A | | 10/1957 | Midkiff | |
| 2,836,210 | A | | 5/1958 | Garofalo | |
| 2,842,020 | A | | 7/1958 | Traquinio | |
| 2,844,244 | A | | 7/1958 | Hanson | |
| 2,854,741 | A | | 10/1958 | Cholger | |
| 2,878,701 | A | | 3/1959 | Weersma | |
| 3,023,054 | A | | 2/1962 | Shigekuni | |
| 3,061,927 | A | | 11/1962 | Von Frankenberg Und Ludwingdorf | |
| 3,113,479 | A | | 12/1963 | Swingle | |
| 3,156,143 | A | | 11/1964 | Wolf | |
| 3,222,959 | A | | 12/1965 | Clark | |
| 3,255,792 | A | | 6/1966 | Beck | |
| 3,257,991 | A | | 6/1966 | Mosch | |
| D205,745 | S | | 9/1966 | Namfeldt | |
| 3,342,229 | A | | 9/1967 | Janes | |
| 3,343,434 | A | * | 9/1967 | Schroeder | 81/60 |
| 3,424,039 | A | | 1/1969 | Scott | |
| 3,592,086 | A | | 7/1971 | Derwin | |
| 3,654,975 | A | * | 4/1972 | Ballsmith et al. | 81/32 |
| 3,667,518 | A | | 6/1972 | Stillwagon, Jr. | |
| 3,802,286 | A | | 4/1974 | Winklhofer et al. | |
| 3,863,693 | A | | 2/1975 | Carniker | |
| 3,943,801 | A | | 3/1976 | Yates | |
| 3,958,469 | A | | 5/1976 | Meese | |
| 3,997,053 | A | | 12/1976 | Bondhus | |
| 4,000,767 | A | | 1/1977 | Geng | |
| 4,043,230 | A | | 8/1977 | Scrivens | |
| 4,154,125 | A | | 5/1979 | Frank | |
| 4,196,761 | A | | 4/1980 | Royer | |
| 4,227,430 | A | | 10/1980 | Jameson et al. | |
| 4,235,269 | A | | 11/1980 | Kraus | |
| 4,238,862 | A | | 12/1980 | Leatherman | |
| 4,241,773 | A | | 12/1980 | Personnat | |
| 4,302,990 | A | | 12/1981 | Chrichton et al. | |
| 4,308,770 | A | | 1/1982 | MacDonald | |
| 4,327,790 | A | | 5/1982 | Stevens et al. | |
| 4,384,499 | A | | 5/1983 | Shockley | |
| D270,024 | S | | 8/1983 | Strasser | |
| 4,424,728 | A | | 1/1984 | MacDonald | |
| 4,448,097 | A | | 5/1984 | Rocca | |
| 4,469,109 | A | | 9/1984 | Mehl | |
| 4,476,751 | A | | 10/1984 | Mishima | |
| 4,525,889 | A | | 7/1985 | Dunau | |
| 4,542,667 | A | | 9/1985 | Jang | |
| 4,699,020 | A | | 10/1987 | Bush et al. | |
| 4,703,673 | A | | 11/1987 | Allen | |
| 4,711,353 | A | | 12/1987 | Rozmestor | |
| 4,716,795 | A | | 1/1988 | Corona et al. | |
| 4,716,796 | A | | 1/1988 | Corona et al. | |
| 4,767,006 | A | | 8/1988 | Wasem | |
| 4,783,867 | A | | 11/1988 | Tsao | |
| 4,787,276 | A | | 11/1988 | Condon | |
| 4,815,346 | A | | 3/1989 | Littlehorn | |
| 4,819,523 | A | | 4/1989 | Souza | |
| 4,819,800 | A | | 4/1989 | Wilson | |
| 4,820,090 | A | | 4/1989 | Chen | |
| D302,102 | S | | 7/1989 | Amagaya | |
| 4,882,841 | A | | 11/1989 | Margolis | |
| 4,926,721 | A | | 5/1990 | Hsiao | |
| D308,462 | S | | 6/1990 | Komatsu | |
| 4,934,223 | A | | 6/1990 | Wong | |
| D310,770 | S | | 9/1990 | Zamarripa | |
| D311,124 | S | | 10/1990 | Learney | |
| 4,960,016 | A | | 10/1990 | Seals | |
| 4,974,477 | A | | 12/1990 | Anderson | |
| 4,979,407 | A | | 12/1990 | Hernandez et al. | |
| 5,029,707 | A | | 7/1991 | Feng | |
| 5,036,975 | A | | 8/1991 | Chow | |
| 5,062,173 | A | | 11/1991 | Collins et al. | |
| 5,063,796 | A | | 11/1991 | Gennep | |
| 5,065,487 | A | | 11/1991 | Yother | |
| 5,086,674 | A | | 2/1992 | Her | |
| 5,146,815 | A | | 9/1992 | Scott, III | |
| 5,147,038 | A | | 9/1992 | Pergeau | |
| D333,769 | S | | 3/1993 | Jureckson | |
| D334,516 | S | | 4/1993 | Tsunoda | |
| D339,048 | S | | 9/1993 | Baum | |
| 5,263,389 | A | | 11/1993 | Frazzell et al. | |
| 5,265,504 | A | | 11/1993 | Fruhm | |
| D342,433 | S | | 12/1993 | Sorenson | |
| 5,271,300 | A | | 12/1993 | Zurbuchen et al. | |
| D343,106 | S | | 1/1994 | Eklind et al. | |
| 5,295,422 | A | | 3/1994 | Chow | |
| 5,320,004 | A | | 6/1994 | Hsiao | |
| 5,329,834 | A | | 7/1994 | Wong | |
| 5,394,984 | A | | 3/1995 | Aiba | |
| D359,671 | S | | 6/1995 | Acosta | |
| 5,450,774 | A | | 9/1995 | Chang | |
| 5,450,775 | A | | 9/1995 | Kozak | |
| 5,461,950 | A | | 10/1995 | Iwinski | |
| D365,681 | S | | 1/1996 | Chow | |
| 5,480,166 | A | * | 1/1996 | Milsop | 279/143 |
| 5,495,942 | A | | 3/1996 | Ishak | |
| 5,499,560 | A | | 3/1996 | Aeschliman | |
| 5,499,562 | A | | 3/1996 | Feng | |
| 5,517,885 | A | | 5/1996 | Feng | |
| 5,522,291 | A | | 6/1996 | Liu | |
| 5,535,882 | A | | 7/1996 | Liu | |
| D373,943 | S | | 9/1996 | Fuhrmann | |
| 5,553,340 | A | | 9/1996 | Brown, Jr. | |
| 5,566,596 | A | | 10/1996 | Lin | |
| D376,520 | S | | 12/1996 | Morin | |
| 5,581,834 | A | | 12/1996 | Collins | |
| D377,444 | S | | 1/1997 | Lin | |
| 5,592,859 | A | | 1/1997 | Johnson et al. | |
| D378,797 | S | | 4/1997 | Poremba et al. | |
| D380,131 | S | | 6/1997 | Sung | |
| D382,190 | S | | 8/1997 | Blackston et al. | |
| 5,653,525 | A | | 8/1997 | Park | |
| D383,048 | S | | 9/1997 | Sorensen et al. | |
| 5,662,013 | A | | 9/1997 | Lin | |
| D385,172 | S | | 10/1997 | Bramsiepe et al. | |
| D386,955 | S | | 12/1997 | Jones et al. | |
| D388,609 | S | | 1/1998 | Chan | |

5,711,042 A 1/1998 Chuang
D394,792 S 6/1998 Bourque
D394,794 S 6/1998 Vasudeva
5,758,870 A 6/1998 Weaver
5,765,247 A 6/1998 Seber et al.
5,765,454 A * 6/1998 Barbulescu et al. ..... 81/487
5,791,211 A 8/1998 Bondhus et al.
5,803,584 A 9/1998 Chung
5,820,288 A 10/1998 Cole
D400,775 S 11/1998 Hsu
5,855,274 A 1/1999 Piao
D405,335 S 2/1999 Lin
5,911,799 A 6/1999 Johnson et al.
5,916,277 A 6/1999 Dallas
5,916,341 A 6/1999 Lin
5,918,513 A 7/1999 Ho
5,970,828 A 10/1999 Bondhus et al.
D415,946 S 11/1999 Tsai
5,983,759 A 11/1999 Turner
5,992,626 A 11/1999 Anderson
D420,885 S 2/2000 Lin
1,337,769 A 4/2000 Hemming
D426,449 S 6/2000 Eklind
D426,450 S 6/2000 Eklind
D427,875 S 7/2000 Chiu
6,085,620 A 7/2000 Anderson et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Bondhus et al.
D433,613 S 11/2000 Jialin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 * 2/2001 Rogers et al. ..... 433/141
6,206,189 B1 3/2001 Huot, Jr. et al.
6,233,769 B1 5/2001 Seber et al.
6,237,451 B1 5/2001 Wei
6,279,434 B1 8/2001 Brown
D448,267 S 9/2001 Jean et al.
6,308,599 B1 10/2001 Fu-Hui
6,311,587 B1 11/2001 Johnson et al.
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
D455,630 S 4/2002 Chiu
6,382,057 B1 5/2002 Kienholz
6,389,931 B1 5/2002 Delaney et al.
6,397,709 B1 6/2002 Wall
6,401,576 B1 6/2002 Wu
6,405,620 B2 6/2002 Liao
D459,967 S 7/2002 Johnson et al.
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
D479,963 S 9/2003 Chang
6,675,678 B2 1/2004 Liu
6,698,318 B2 3/2004 Peters
6,739,224 B1 5/2004 Wershe
6,751,819 B2 6/2004 Chuang
6,752,046 B1 6/2004 Lee
6,758,350 B2 7/2004 Lin
6,763,744 B2 7/2004 Johnson et al.
D494,438 S 8/2004 Falkenstein et al.
6,799,490 B1 10/2004 Chu
6,877,186 B2 4/2005 Shiao
6,898,998 B2 5/2005 Shyu
6,901,826 B2 6/2005 Huang
6,918,323 B2 * 7/2005 Arnold et al. ..... 81/63.2
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al.
6,948,406 B1 9/2005 Li
6,968,758 B2 11/2005 Lin
D517,391 S 3/2006 Leins
7,028,593 B1 4/2006 Lin et al.
7,051,629 B2 5/2006 Huang
D523,637 S 6/2006 Chang
7,073,418 B2 7/2006 Kuo
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,216,569 B2 5/2007 Abdelgany
7,237,463 B1 7/2007 Lee
D548,464 S 8/2007 Lin
D549,069 S 8/2007 Lin et al.
7,281,454 B2 10/2007 Johnson et al.
7,284,466 B1 10/2007 Ho
D557,099 S 12/2007 Lin
7,305,908 B2 12/2007 Chi
7,467,574 B1 12/2008 Lin
7,467,575 B2 12/2008 Lai
7,565,852 B2 7/2009 Yu
7,743,685 B2 6/2010 Chang
D623,037 S 9/2010 Johnson et al.
7,836,534 B2 11/2010 Simmons
7,946,203 B2 5/2011 Johnson et al.
8,011,277 B2 9/2011 Johnson et al.
8,015,642 B1 9/2011 Oakley
8,033,200 B2 10/2011 Johnson et al.
D650,257 S 12/2011 Royes et al.
2001/0005576 A1 * 6/2001 Rogers et al. ..... 433/141
2003/0047474 A1 3/2003 Dahlson
2003/0126957 A1 7/2003 Huang
2003/0188610 A1 10/2003 Lin
2003/0226428 A1 12/2003 Liu
2004/0050218 A1 3/2004 Napoli
2004/0173061 A1 9/2004 Liou
2004/0262344 A1 12/2004 White
2005/0011318 A1 1/2005 Tsai
2005/0229752 A1 10/2005 Nickipuck
2005/0247587 A1 11/2005 Holland-Letz
2005/0268752 A1 12/2005 Johnson et al.
2006/0101955 A1 5/2006 Chang
2006/0118500 A1 6/2006 Chen
2006/0150784 A1 7/2006 Hsieh
2006/0213059 A1 9/2006 Eggert
2006/0288823 A1 12/2006 Schepman
2007/0023306 A1 2/2007 Lai
2007/0151402 A1 7/2007 Schneeman et al.
2007/0221017 A1 9/2007 Heaven
2007/0228672 A1 * 10/2007 Huang ..... 279/58
2007/0245862 A1 10/2007 Gonzalez et al.
2007/0295171 A1 12/2007 Johnson et al.
2008/0128370 A1 6/2008 Shih
2008/0148909 A1 6/2008 Lai
2008/0156754 A1 7/2008 Cheng
2008/0164171 A1 7/2008 Meng
2008/0190249 A1 8/2008 Yu
2008/0202963 A1 8/2008 Liao
2008/0251402 A1 10/2008 Chiu

| | | | |
|---|---|---|---|
| 2008/0271573 | A1 | 11/2008 | Lown et al. |
| 2008/0295657 | A1 | 12/2008 | Cluthe |
| 2009/0107303 | A1 | 4/2009 | Steinweg et al. |
| 2009/0183608 | A1 | 7/2009 | Johnson et al. |
| 2009/0183609 | A1 | 7/2009 | Johnson et al. |
| 2009/0241740 | A1 | 10/2009 | Heagerty |
| 2011/0000024 | A1 | 1/2011 | Johnson et al. |

FOREIGN PATENT DOCUMENTS

| | | | |
|---|---|---|---|
| DE | 2453480 | A1 | 5/1976 |
| DE | 3744176 | A1 | 8/1989 |
| EP | 856233 | | 12/1960 |
| EP | 503559 | A1 | 9/1992 |
| EP | 618046 | A1 | 10/1994 |
| FR | 787512 | | 9/1935 |
| JP | 55045442 | U | 3/1980 |
| JP | 57-13165 | | 1/1982 |
| JP | 3-47775 | | 5/1991 |
| JP | 4-29368 | | 3/1992 |
| JP | 5-31882 | | 4/1993 |
| WO | 83/01406 | | 4/1983 |
| WO | 97/29887 | | 8/1997 |

* cited by examiner

UNIVERSAL RATCHETING TOOL

This patent application is a continuation application of the co-pending U.S. patent application Ser. No. 12/009,524 entitled UNIVERSAL RATCHETING TOOL and filed on Jan. 17, 2008. The U.S. patent application Ser. No. 12/009,524 entitled UNIVERSAL RATCHETING TOOL and filed on Jan. 17, 2008 is hereby incorporated by reference.

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as alien wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

A universal ratcheting tool provides improved handling of tools that are difficult to use on their own, specifically, hexagonal wrenches. The universal ratcheting tool includes a handle and a body with a ratcheting mechanism within the handle. The body includes a first aperture for receiving a tool, and the first aperture includes slots to accept a plurality of sizes of tools. The body also includes a second aperture where the tool extends out of the body. A retaining component is coupled with the body to retain the tool and a retaining tab is able to be used to open and close the retaining component. Once the tool is positioned and retained within the universal ratcheting tool, a user is able to easily install or remove an object such as a screw with the benefit of a comfortable handle and the ease of use of the ratcheting mechanism.

In one aspect, a device comprises a handle including a first segment and a second segment, an aperture within the second segment, the aperture configured for receiving a tool, a retaining component coupled to the body for retaining the tool and a ratcheting mechanism within the handle for enabling ratcheting movements. The device further comprises one or more directional tabs for configuring orientation of the ratcheting mechanism. The device further comprises a retaining tab for opening and closing the retaining component. The aperture includes a plurality of slots configured for receiving a plurality of sizes of tools. The retaining component includes at least one arm for retaining the tool. The first segment of the handle is a hand-held size. The tool includes an elongated rod having a bend through a predetermined angle and including a proximal end for engaging an object, and a mounting end between the bend and a distal end.

In another aspect, a device comprises a handle component, a body component coupled with the handle component, an aperture within the body component, the aperture configured for receiving a plurality of sizes of tools, a retaining component coupled with the body component for retaining a tool of the plurality of sizes of tools and a ratcheting mechanism within the handle component for enabling ratcheting movements. The device further comprises one or more directional tabs for configuring orientation of the ratcheting mechanism. The device further comprises a retaining tab for opening and closing the retaining component. The aperture includes a plurality of slots configured for receiving the plurality of sizes of tools. The retaining component includes at least one arm for retaining the tool. The handle component is a hand-held size. The tool includes an elongated rod having a bend through a predetermined angle and including a proximal end for engaging an object, and a mounting end between the bend and a distal end.

In another aspect, a device comprises a handle component sized for a person's hand, a ratcheting mechanism within the handle component for enabling ratcheting movements, a body component coupled with the handle component, a first aperture within the body component, the first aperture configured with a plurality of slots to receive a plurality of sizes of tools, a second aperture within the body component, the second aperture configured to allow a tool of the plurality of sizes of tools to extend out of the body component, a retaining component coupled with the body component for retaining the tool and a retaining tab for opening and closing the retaining component. The device further comprises one or more directional tabs for configuring orientation of the ratcheting mechanism. The retaining component includes at least one arm for retaining the tool. The tool includes an elongated rod having a bend through a predetermined angle and including a proximal end for engaging an object, and a mounting end between the bend and a distal end.

In yet another aspect, a method of utilizing a universal ratcheting tool comprises positioning a tool within a first aperture of the universal ratcheting tool, the tool extending through a second aperture of the universal ratcheting tool, retaining the tool within the universal ratcheting tool and turning the universal ratcheting tool while the tool is inserted into an object. The method further comprising configuring an orientation of the universal ratcheting tool before turning the universal ratcheting tool. Retaining the tool within the universal ratcheting tool is implemented with a retaining component. The first aperture includes a plurality of slots configured for receiving a plurality of sizes of tools. The tool includes an elongated rod having a bend through a predetermined angle and including a proximal end for engaging an object, and a mounting end between the bend and a distal end.

DETAILED DESCRIPTION OF THE PREFERRED EMBODIMENT

A universal ratcheting tool provides an improved handle for turning a tool such as a hexagonal wrench.

Figure 1:
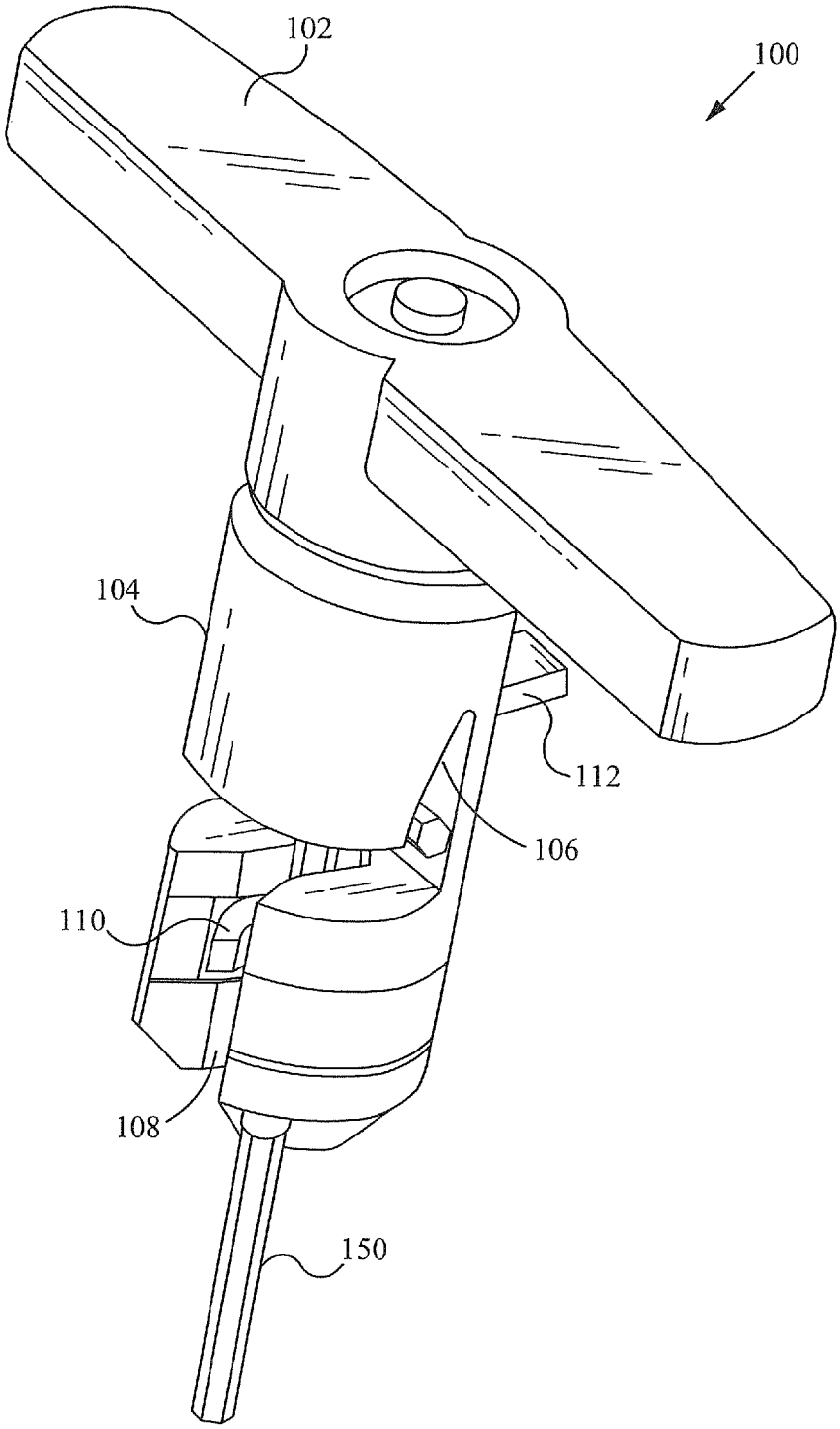
FIG. 1 illustrates a top-side perspective view of a universal ratcheting tool with a tool inserted in accordance with the apparatus of the present invention.

FIG. 1 illustrates a top-side perspective view of a universal ratcheting tool 100 with a tool 150 inserted in accordance with the apparatus of the present invention. In some embodiments, the tool 150 is a hexagonal wrench. The universal ratcheting tool 100 includes a handle component 102 coupled with a body component 104. The handle component 102 is able to be any size, shape or configuration. In some embodiments, the size and shape is such that a user is able to grip the handle with a single hand. The body component 104 includes a first aperture 106. In some embodiments, the first aperture 106 is shaped to universally receive tools of different sizes. The shape of the first aperture 106 is such that the top of the first aperture 106 is able to receive a small tool, the bottom of the first aperture 106 is able to receive a large tool and the middle of the first aperture 106 is able to receive tools sized between small and large. In some embodiments, the first aperture 106 has distinct slots which are each able to receive a correspondingly-sized tool. The body 104 also includes a second aperture 108 to allow the opposite end of the tool 150 to protrude out of the bottom of the universal ratcheting tool 100. A retaining component 110 retains the tool 150 to prevent the tool 150 from falling out of the universal ratcheting tool 100. The retaining component 110 is implemented in any way to prevent the tool 150 from falling out, but in some embodiments, the retaining component 110 includes at least one arm, preferably two arms, which close around the tool 150. To open and close the retaining component 110, a retaining tab 112 is utilized, in some embodiments. The retaining tab 112 includes a pointed end which pushes the retaining component 110 closed when pushed down. In some embodiments, the retaining component 110 is spring-loaded so that the retaining component 110 is in an open position unless the retaining tab 112 is positioned to close the retaining component 110. In some embodiments, the retaining component 110 is spring-loaded so that the retaining component 110 is in a closed position unless the retaining tab 112 is positioned to open the retaining component 110.

When inserted into the first aperture 106 and the second aperture 108 of the body 104, the tool 150 is positioned in the appropriately sized slot with the short leg or mounting end of the tool 150 positioned in the slot and the long leg of the tool 150 extending through the second aperture 108 formed through a bottom of the body 104. The tool 150 includes an elongated rod having a bend through a predetermined angle. A proximal end of the tool 150 is for engaging an object such as a screw which is driven by the tool 150. The short leg member or mounting end of the tool 150 extends from the bend to a distal end.

Figure 2:
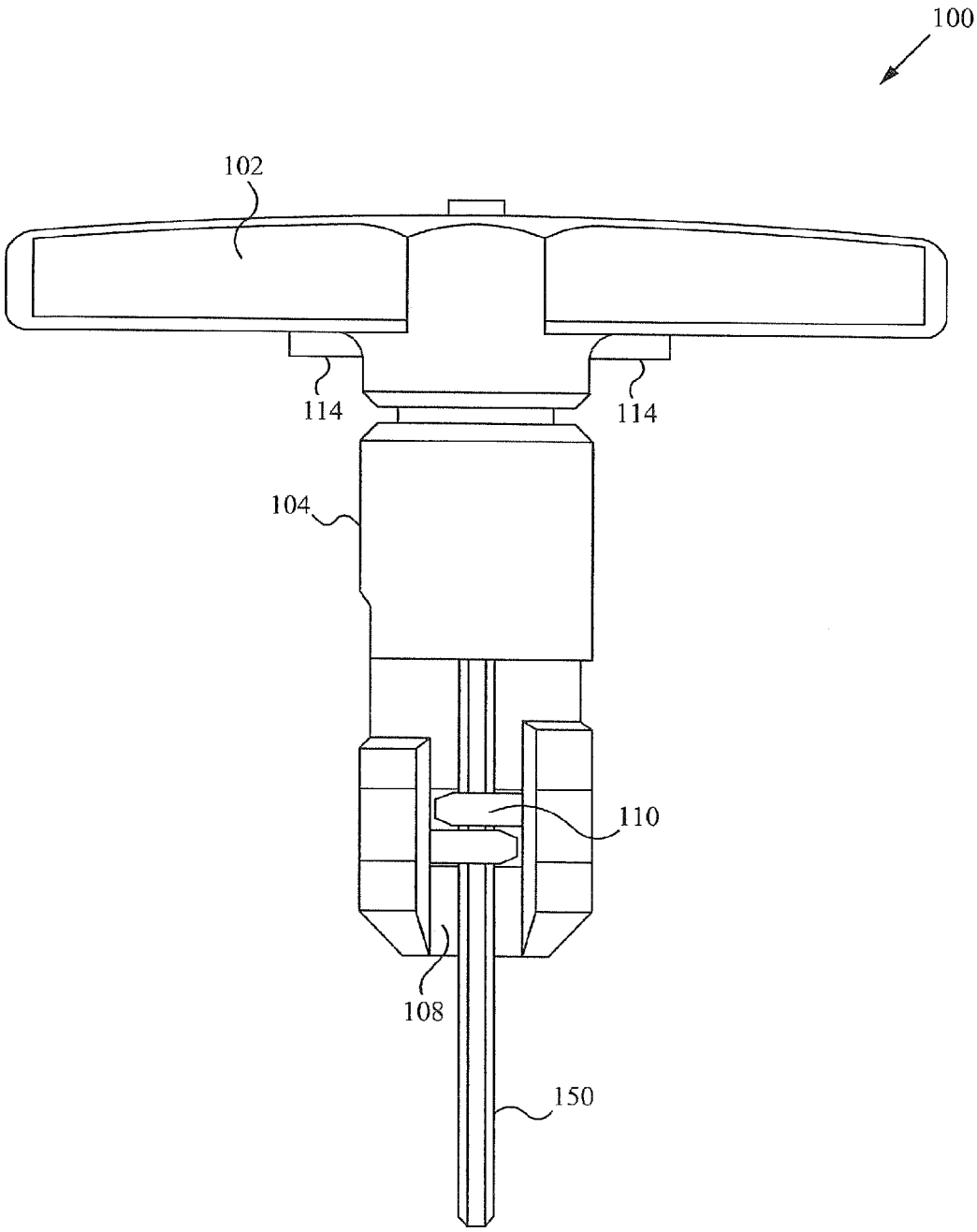
FIG. 2 illustrates a front view of a universal ratcheting tool including a tool in accordance with the apparatus of the present invention.

FIG. 2 illustrates a front view of a universal ratcheting tool 100 including a tool 150 in accordance with the apparatus of the present invention. As described above, the universal ratcheting tool 100 includes a handle component 102 and a body component 104. The body component 104 includes a first aperture 106 (FIG. 1) which is where the short leg or mounting end of the tool 150 is positioned, and a second aperture 108 which is where the long leg of the tool 150 extends through. A retaining component 110 retains the tool 150 within the body 104 when the retaining component 110 is in a closed configuration as shown. Directional tabs 114 enable selection of which way an internal ratcheting mechanism 116 (FIG. 5) functions, thus allowing a user to use the universal ratcheting tool to tighten and loosen objects.

Figure 3:
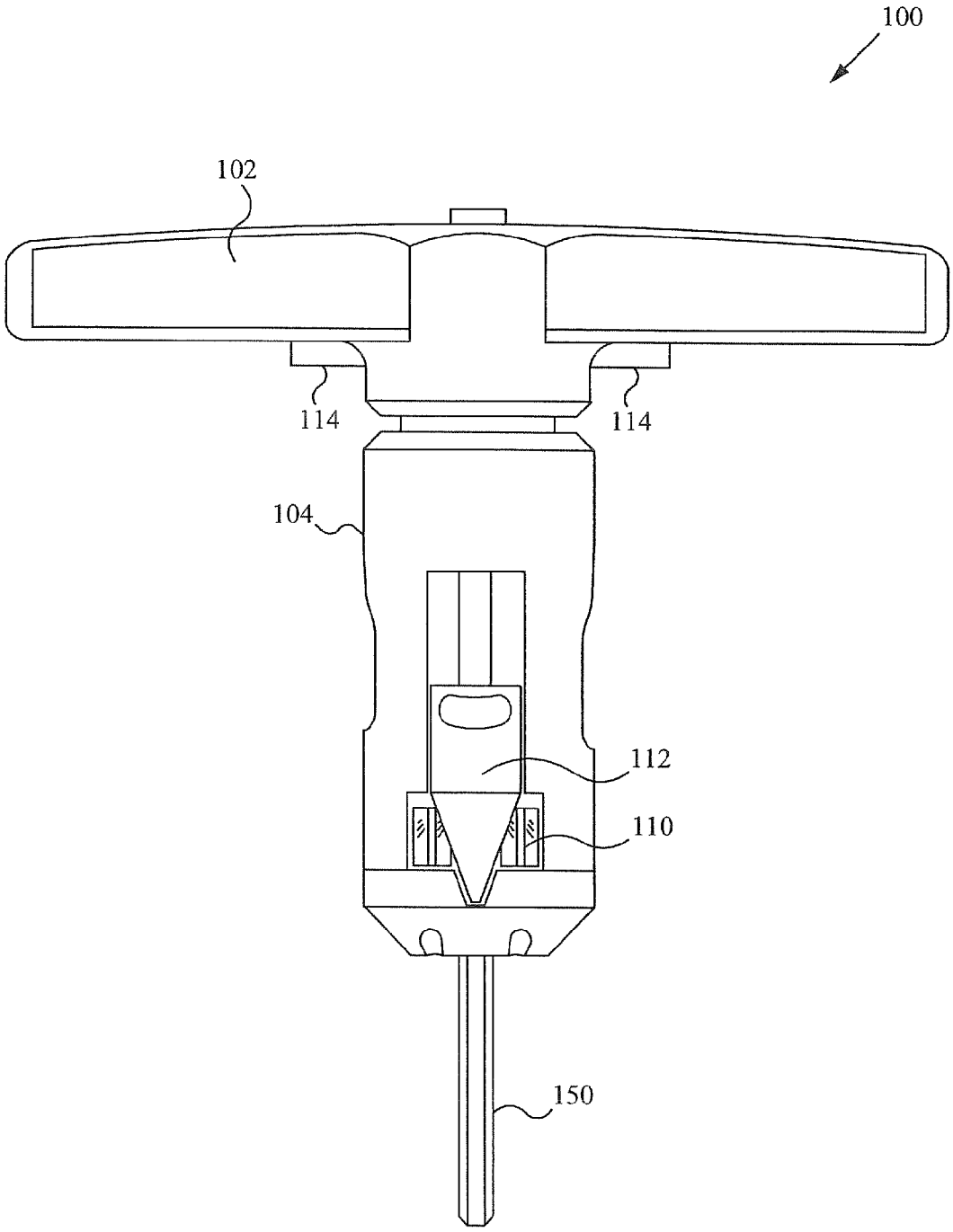
FIG. 3 illustrates a back view of a universal ratcheting tool including a tool in accordance with the apparatus of the present invention.

FIG. 3 illustrates a back view of a universal ratcheting tool 100 including a tool 150 in accordance with the apparatus of the present invention. The universal ratcheting tool 100 includes a handle component 102 and a body component 104. The universal ratcheting tool 100 also includes a retaining tab 112 coupled with the body component 104. The retaining tab 112 is able to slide up and down to open and close a retaining component 110 which retains the tool 150. As shown, the retaining tab 112 is in the down position and the pointed end of the retaining tab 112 pushes the back of the retaining component apart which, in turn, closes the retaining component around the tool 150. In some embodiments, the retaining component 110 and the retaining tab 112 are configured so that when the retaining tab 112 is pushed down into the retaining component 110, the retaining component 110 opens. As described above, directional tabs 114 enable selection of which way the ratcheting mechanism 116 (FIG. 5) functions.

Figure 4A:
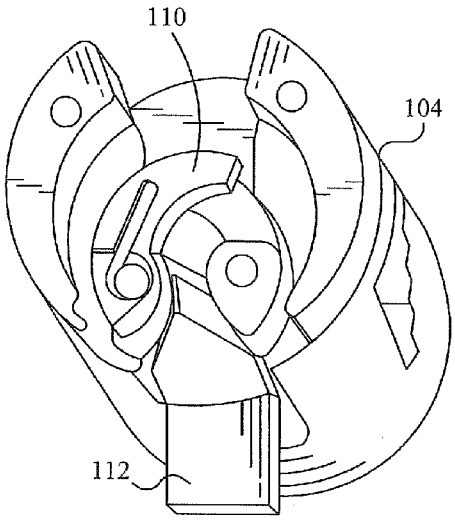
FIG. 4A illustrates a bottom view of part of the body of the universal ratcheting tool with the retaining component and the retaining tab in a closed position in accordance with the apparatus of the present invention.

FIG. 4A illustrates a bottom view of part of the body 104 of the universal ratcheting tool 100 with the retaining component 110 and the retaining tab 112 in a closed position in accordance with the apparatus of the present invention. When the retaining tab 112 is down or in a direction for closing, the retaining component 110 is closed. In some embodiments, the retaining tab 112 works by having a pointed end protrude between the backs of the arms of the retaining component 110 which pushes the fronts of the arms closer together.

Figure 4B:
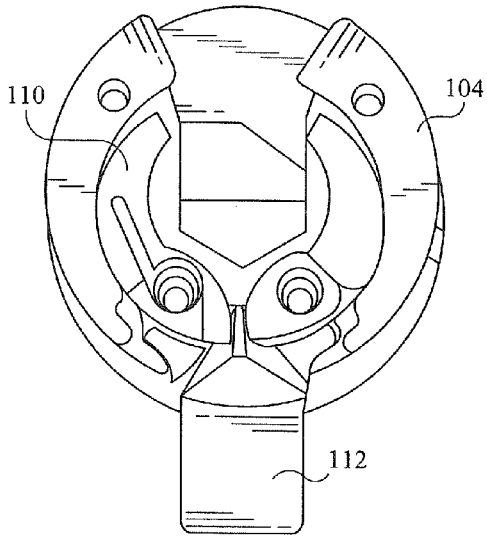
FIG. 4B illustrates a bottom view of part of the body of the universal ratcheting tool with the retaining component and the retaining tab in an open position in accordance with the apparatus of the present invention.

FIG. 4B illustrates a bottom view of part of the body 104 of the universal ratcheting tool 100 with the retaining component 110 and the retaining tab 112 in an open position in accordance with the apparatus of the present invention. When the retaining tab 112 is up or in a direction for opening, the retaining component 110 is open. In some embodiments, the retaining component is spring-loaded which causes the arms to open when the retaining tab 112 is not pushing them closed.

Figure 5:
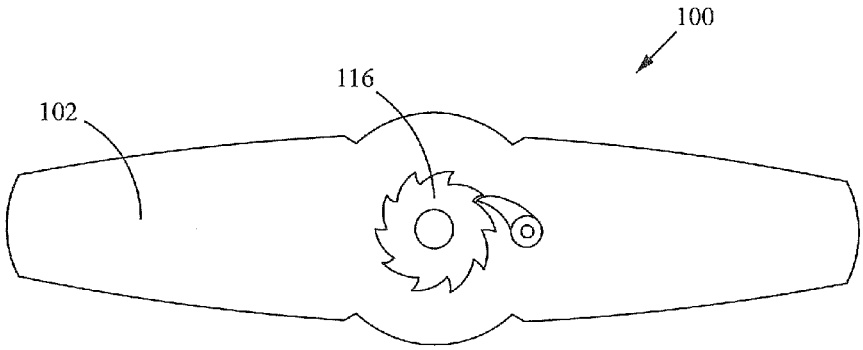
FIG. 5 illustrates a cross sectional view of a universal ratcheting tool including a ratcheting mechanism in accordance with the apparatus of the present invention.

FIG. 5 illustrates a cross sectional view of a universal ratcheting tool 100 including a ratcheting mechanism 116 in accordance with the apparatus of the present invention. The ratcheting mechanism 116 is located within the handle 102, the body 104 and/or any other appropriate part of the universal ratcheting tool 100. The ratcheting mechanism 116 is implemented as any ratcheting mechanism known in the art. Ratchets work generally by having a form of gear wheel that, instead of having regular teeth, has teeth set off at an angle, and a stiff, thin protrusion referred to as a pawl that rests against the gear wheel. When the gear wheel is rotated in one direction, the protrusion raises and clicks back in place. Because of the shape of the gear wheel it is difficult to push the protrusion back and over the tooth of the gear. Alternatively, this gear wheel can be set in a molding shaped to admit rotation of this gear wheel in one direction only. If the gear wheel is rotated backwards, the molding and the teeth will clash. By implementing a ratcheting mechanism, a user does not have to continuously turn, remove his hand from the handle, place his hand on the handle again, turn and so forth. The ratcheting mechanism enables the user to continuously keep his hand on the handle and simply turn the handle back and forth similar to other ratcheting tools. In some embodiments, the ratcheting tool 100 is configured so that the moveable direction of the handle is configurable. For example, the handle is able to be configured to turn a tool clockwise or counterclockwise.

Figure 6:
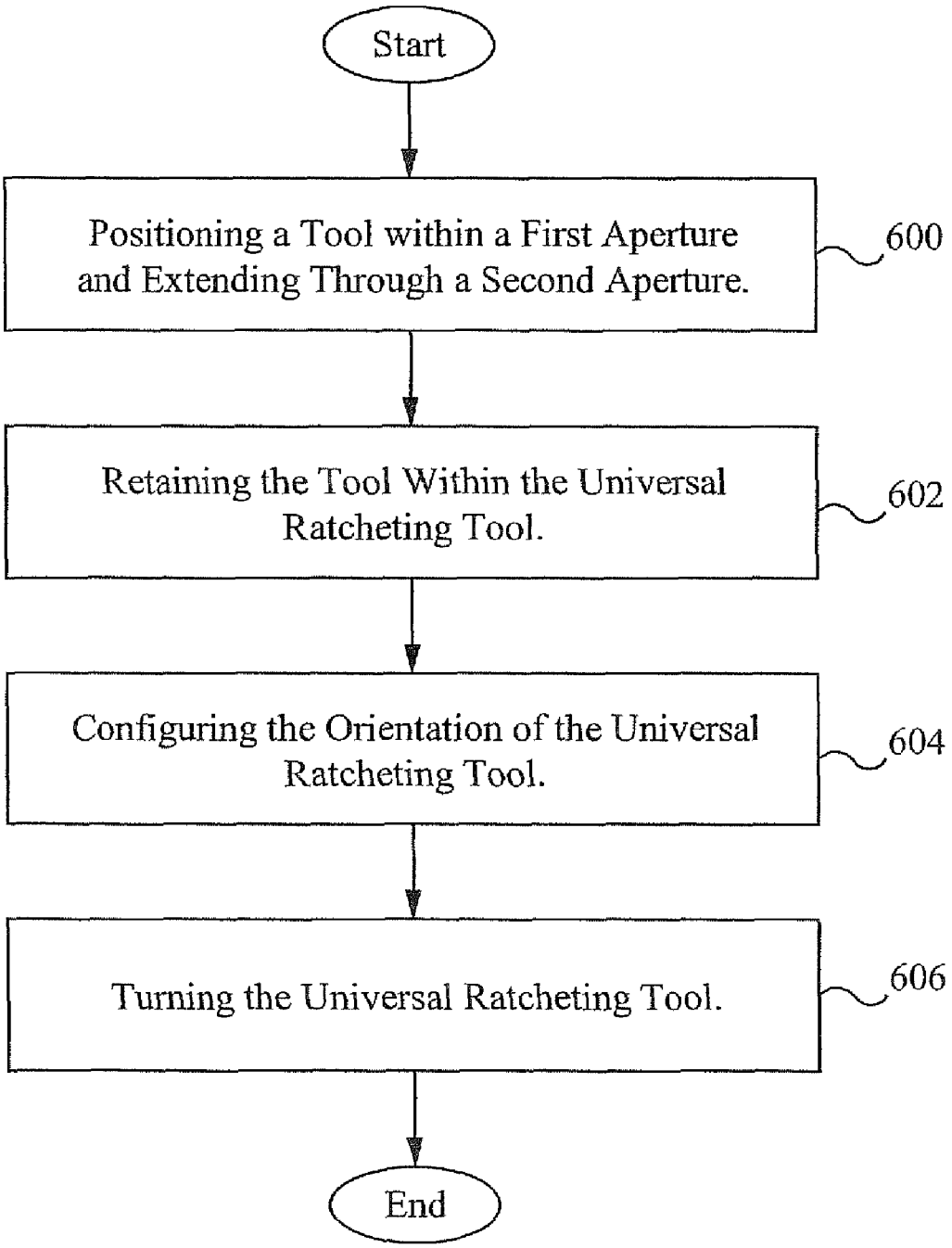
FIG. 6 illustrates a flowchart of a method of utilizing the universal ratcheting tool in accordance with the apparatus of the present invention.

FIG. 6 illustrates a flowchart of a method of utilizing the universal ratcheting tool in accordance with the apparatus of the present invention. In the step 600, a tool is positioned within the first aperture and extending through the second aperture. Specifically, the tool is positioned within the corresponding slot within the first aperture. In the step 602, the tool is retained within the universal ratcheting tool by closing the retaining component using the retaining tab. In some embodiments, the retaining component is closed in another way such as without a retaining tab. If desired or necessary, the ratcheting mechanism orientation is configured so that the universal ratcheting tool is able to tighten or loosen an object, in the step 604. The step 604 is able to be performed at any time before the step 606, and in embodiments where the ratcheting mechanism is not configurable, the step 604 is skipped. After positioning the tool into an object such as a screw, the handle is turned to tighten or loosen the object, in the step 606. To remove or replace the tool, reverse steps are taken including opening the retaining component and removing the tool from the first and second apertures.

Figure 7A:
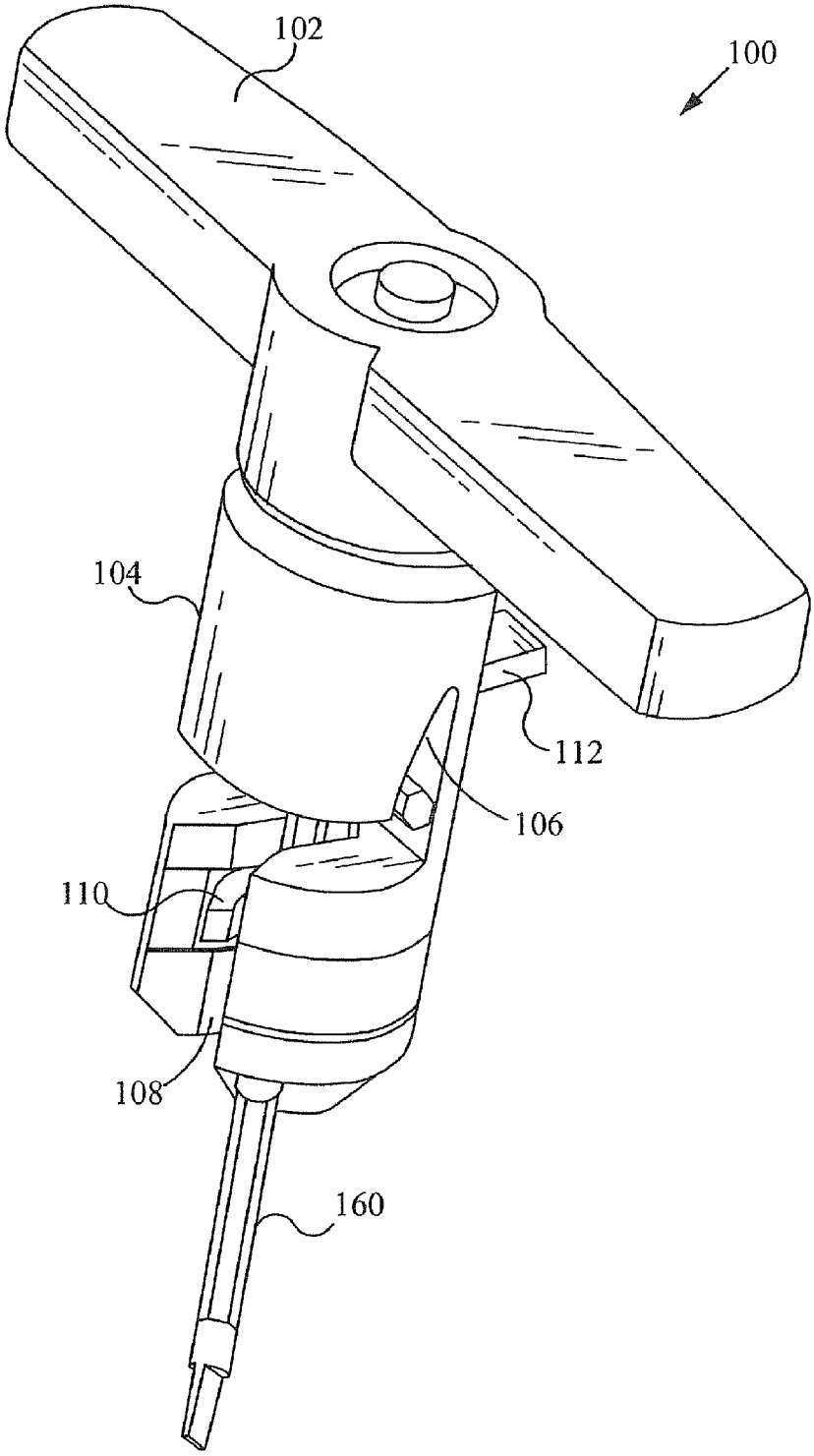
FIG. 7A illustrates a flathead screwdriver with the universal ratcheting tool in accordance with the apparatus of the present invention.
Figure 7B:
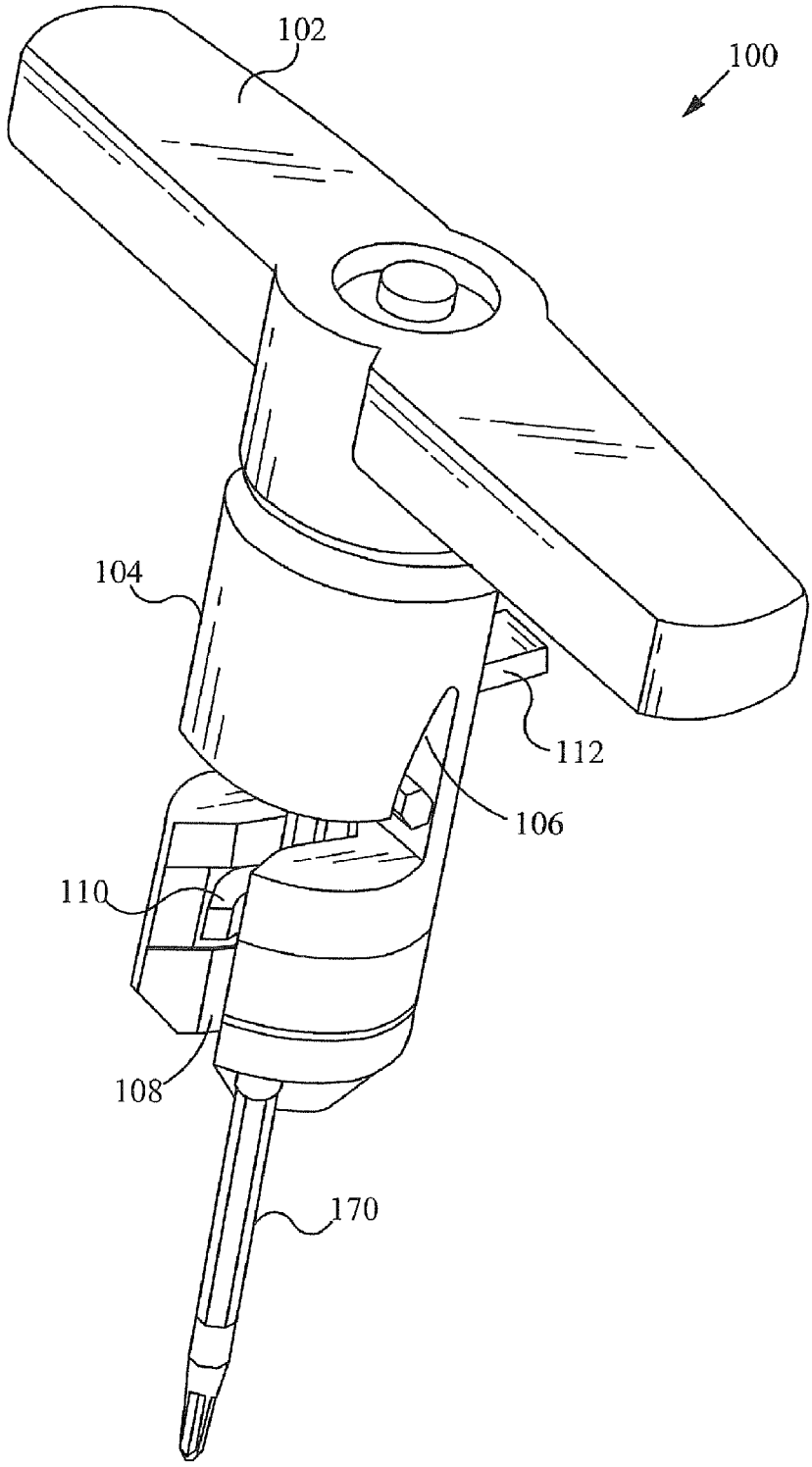
FIG. 7B illustrates a phillips screwdriver with the universal ratcheting tool in accordance with the apparatus of the present invention.
Figure 7C:
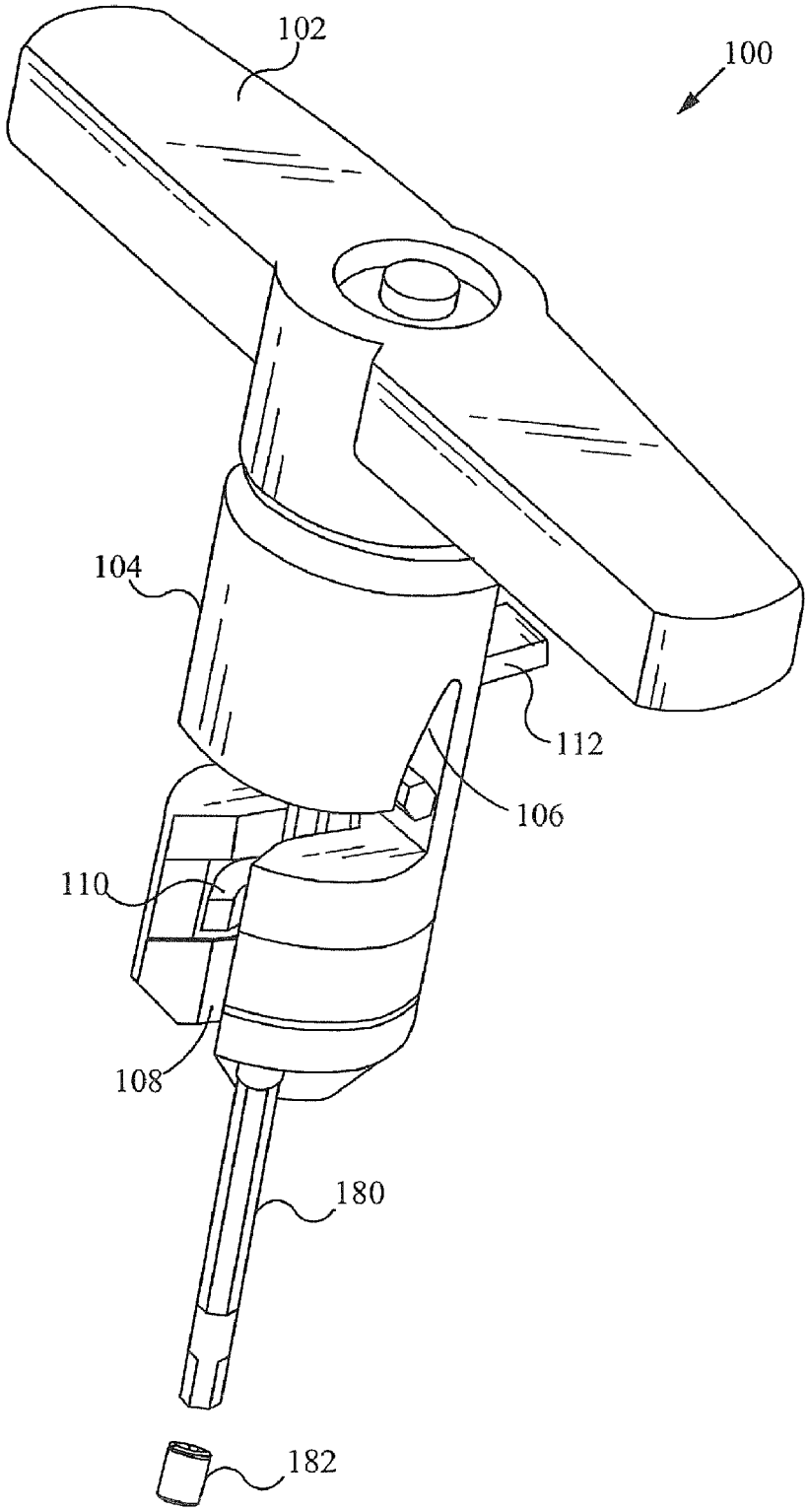
FIG. 7C illustrates a hexagonal socket wrench and corresponding socket with the universal ratcheting tool in accordance with the apparatus of the present invention.

As illustrated in FIGS. 7A, 7B and 7C, the universal ratcheting tool 100 is able to be used with tools other than hexagonal wrenches. A flat screwdriver 160 is able to be used with the universal ratcheting tool 100 by including it on the end of a hexagonal L-shaped bar of a size corresponding to one of the slots, as illustrated in FIG. 7A. A phillips screwdriver 170 is also able to used with the universal ratcheting tool 100 by also including it on the end of a hexagonal L-shaped bar of a size corresponding to one of the slots, as illustrated in FIG. 7B. A socket wrench 180 is also able to be used with the universal ratcheting tool 100 by including it on the end of a hexagonal L-shaped bar of a size corresponding to one of the slots, as illustrated in FIG. 7C. When a socket wrench is held by the universal ratcheting tool 100, sockets 182 of different sizes are then able to be coupled to the socket wrench in order to tighten or loosen nuts and bolts of different sizes. Alternatively, any other appropriate tools are able to be used with the universal ratcheting tool 100.

In some embodiments, the universal ratcheting tool 100 is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the universal ratcheting tool 100 is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench. It should be apparent to one skilled in the an that a universal ratcheting tool 100 is able to be formed to hold fewer, additional or different sizes of hexagonal wrenches.

In some embodiments, the body 104 of the universal ratcheting tool 100 is approximately 3 inches in length. The handle 102 is designed to provide a comfortable, user-friendly interface to a user's hand, in order to enhance a user's ability to exert rotational pressure on the tool 150 without subjecting the user to personal injury or requiring the use of additional tools. As should be apparent to one skilled in the art, the universal ratcheting tool 100 is able to be designed to be of any convenient shape.

The universal ratcheting tool 100 is able to be composed of any appropriate material, which is of maximum strength and includes properties which resist materials that the handle will likely be exposed to, e.g., oil, grease, gasoline and the like. In some embodiments, the universal ratcheting tool 100 is materially composed of 30% glass-filled polycarbonate. In some embodiments, the universal ratcheting tool 100 is materially composed of any suitable composition including, but not limited to aluminum or steel. In some embodiments, the tools 150 are materially composed of aluminum, steel or any other appropriate material.

In some embodiments, the universal ratcheting tool 100 is constructed using an injection molded, core/cavity process as is well known in the art. Alternatively, the universal ratcheting tool 100 is able to be constructed in any known manner.

To utilize a universal ratcheting tool, a tool is positioned within the universal ratcheting tool. The tool is positioned within a first aperture in the universal ratcheting tool. There are slots that shape the first aperture, and the tool fits within one of the slots depending on the size of the tool. The long arm of the tool extends through a second aperture of the universal ratcheting tool for placement in an object such as a screw or a bolt. The tool is retained within the universal ratcheting tool with a retaining component which is opened and closed using a retaining tab. At any time before attempting to turn the object using the universal ratcheting tool, the orientation of the universal ratcheting tool is able to be configured. For example, the universal ratcheting tool is able to be configured to either clockwise or counterclockwise so that the ratchet mechanism allows the tool to be turned in the specified direction which enables the user to either install or remove an object. Once the tool is retained within the universal ratcheting tool, the tool is placed in the object to be turned, and the universal ratcheting tool is turned using the handle. Since the universal ratcheting tool includes a ratcheting mechanism, the user does not need to continuously turn and release the handle. The user's hand is able to remain on the handle, and he is able to turn the handle back and forth with the tool only moving in the desired direction.

In operation, a universal ratcheting tool provides comfort and speed for installing and removing objects such as screws and bolts. A first aperture which is a universal aperture with slots allows many different sized tools to be used by the single universal ratcheting tool. The ratcheting mechanism allows the user to use the tool without having to remove his hand from the handle. A retaining component and a retaining tab retain the tool within the universal ratcheting tool.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A device for removably holding a tool comprising:

a. a body having an axial aperture and a channel substantially perpendicular to the axial aperture that intersects with the axial aperture;

b. a ratcheting mechanism; and c. a retaining component that holds each of a plurality of sized tools by adjusting to the size of the tool.

2. The device of claim 1 wherein the device further comprises a handle.

3. The device of claim 2 wherein the handle is a t-shaped handle.

4. The device of claim 1 further comprising one or more additional apertures.

5. The device of claim 1 further comprising one or more directional tabs for configuring orientation of the ratcheting mechanism.

6. The device of claim 1 further comprising a retaining tab for opening and closing the retaining component.

7. The device of claim 1 wherein the channel or aperture includes a plurality of slots configured for receiving a plurality of sized tools.

8. The device of claim 1 wherein the retaining component includes at least one arm for retaining the tool.

9. A device for removably holding a tool comprising:

a. a non-removably coupled handle; and b. a body comprising:

i. an aperture for receiving a plurality of different sized tools, wherein a top of the aperture is able to receive a different sized tool then a bottom of the aperture; and ii. a ratcheting mechanism.

10. The device of claim 9 further comprising a retaining component that adjustably holds each of a plurality of sized tools.

11. The device of claim 10 wherein the retaining component includes at least one arm for retaining the tool.

12. The device of claim 10 further comprising a retaining tab for opening and closing the retaining component.

13. The device of claim 9 wherein the handle is a t-shaped handle.

14. The device of claim 9 further comprising one or more additional apertures.

15. The device of claim 9 further comprising one or more directional tabs for configuring orientation of the ratcheting mechanism.

16. The device of claim 9 wherein the aperture includes a plurality of slots configured for receiving a plurality of sized tools.

17. A method of using a ratcheting device comprising:

a. inserting a tool within a slot of the ratcheting device having an axial aperture and a channel substantially perpendicular to the axial aperture that intersects with the axial aperture;

b. closing a retaining component to secure the tool; and c. turning the ratcheting device while the tool is inserted into an object.

18. The method of claim 17 further comprising configuring an orientation of the ratcheting device before turning the universal ratcheting tool.

19. The method of claim 17 wherein the retaining component is closed around the tool in order to secure the tool.

20. The method of claim 17 wherein the slot is located within the axial aperture.

21. The method of claim 17 wherein the ratcheting device comprises a plurality of slots.

22. The method of claim 17 wherein the tool is a tool having an L-shaped body including a long leg member and a short leg member.

23. A system for removably holding a tool comprising:

a. a tool having an L-shaped body; and b. a device selectively coupled to the tool comprising:

i. an aperture for receiving the tool;

ii. a ratcheting mechanism; and iii. a retaining component that holds each of a plurality of sized tools by adjusting to the size of the tool.

24. A method of using a ratcheting device comprising:

a. inserting a tool having an L-shaped body within a slot of the ratcheting device;

b. closing a retaining component to secure the tool; and c. turning the ratcheting device while the tool is inserted into an object.

* * * * *

UNITED STATES PATENT AND TRADEMARK OFFICE

CERTIFICATE OF CORRECTION

PATENT NO. : 8,336,428 B2
APPLICATION NO. : 13/228326
DATED : December 25, 2012
INVENTOR(S) : Ronald L. Johnson et al.

It is certified that error appears in the above-identified patent and that said Letters Patent is hereby corrected as shown below:

Column 8:

At Claim 9, line 6 replace "then a bottom of the aperture" with the following:

-- than a bottom of the aperture --.

Signed and Sealed this
Nineteenth Day of February, 2013

Teresa Stanek Rea
*Acting Director of the United States Patent and Trademark Office*